United States Patent [19]

Sears

[11] Patent Number: 4,889,209

[45] Date of Patent: Dec. 26, 1989

[54] SOUND INSULATING CONTAINER FOR AN ELECTRICAL APPLIANCE

[76] Inventor: Charles Sears, Rte. 2, Box 95, Moyock, N.C. 27958

[21] Appl. No.: 202,018

[22] Filed: Jun. 2, 1988

[51] Int. Cl.[4] ..... G10K 11/00

[52] U.S. Cl. ..... 181/200; 220/469

[58] Field of Search ..... 181/198, 200, 201, 202; 220/469

[56] References Cited

U.S. PATENT DOCUMENTS 1,749,177 3/1930 Baxter et al. ..... 181/201 X 2,223,196 11/1940 Watkins ..... 181/201 X 3,160,227 12/1964 Hautala ..... 181/200

*Primary Examiner*—John Fox

*Attorney, Agent, or Firm*—Fleit, Jacobson, Cohn, Price, Holman & Stern

[57] ABSTRACT

Disclosed is a sound insulating container for completely enclosing an electrical appliance. The container includes walls constructed of sound absorbing material and a door attached by hinges for completely closing the container. An electrical outlet is provided inside the container and is connected to a standard wall outlet by a conventional electric cord. A switch provided on the exterior of the container when the door is closed selectively supplies power to the interior outlet.

3 Claims, 2 Drawing Sheets

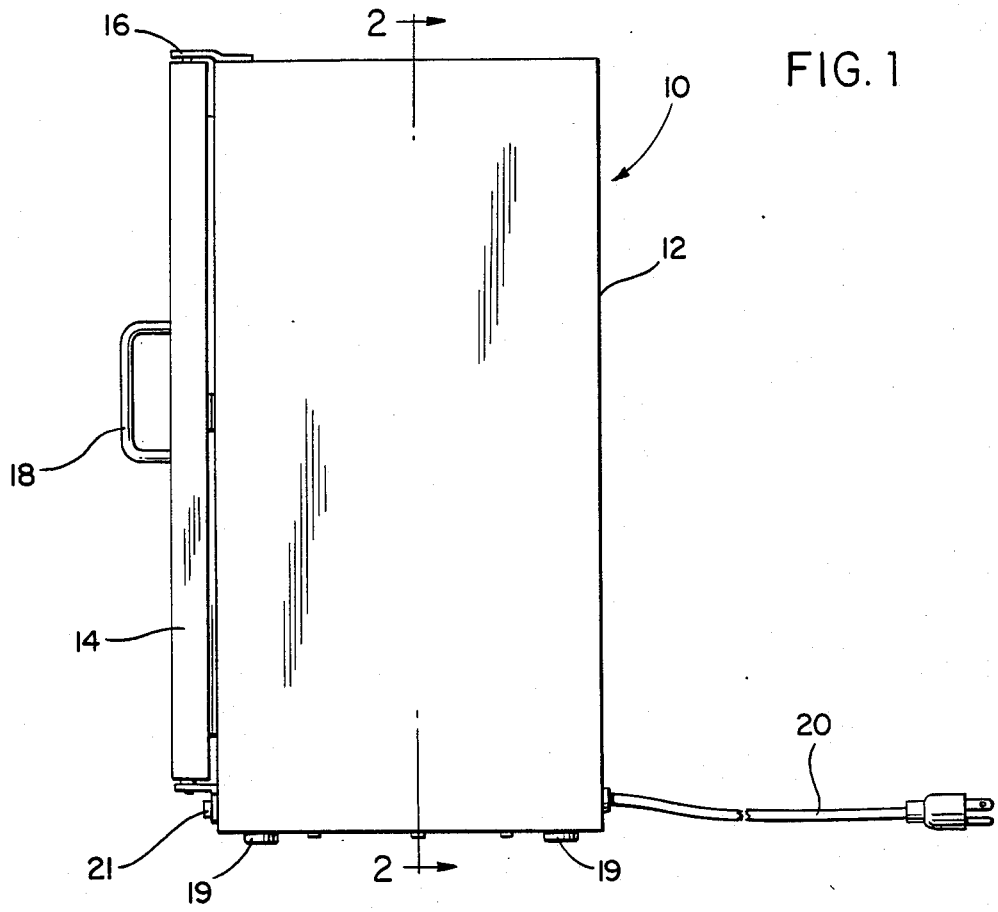
FIG. 1
FIG. 3
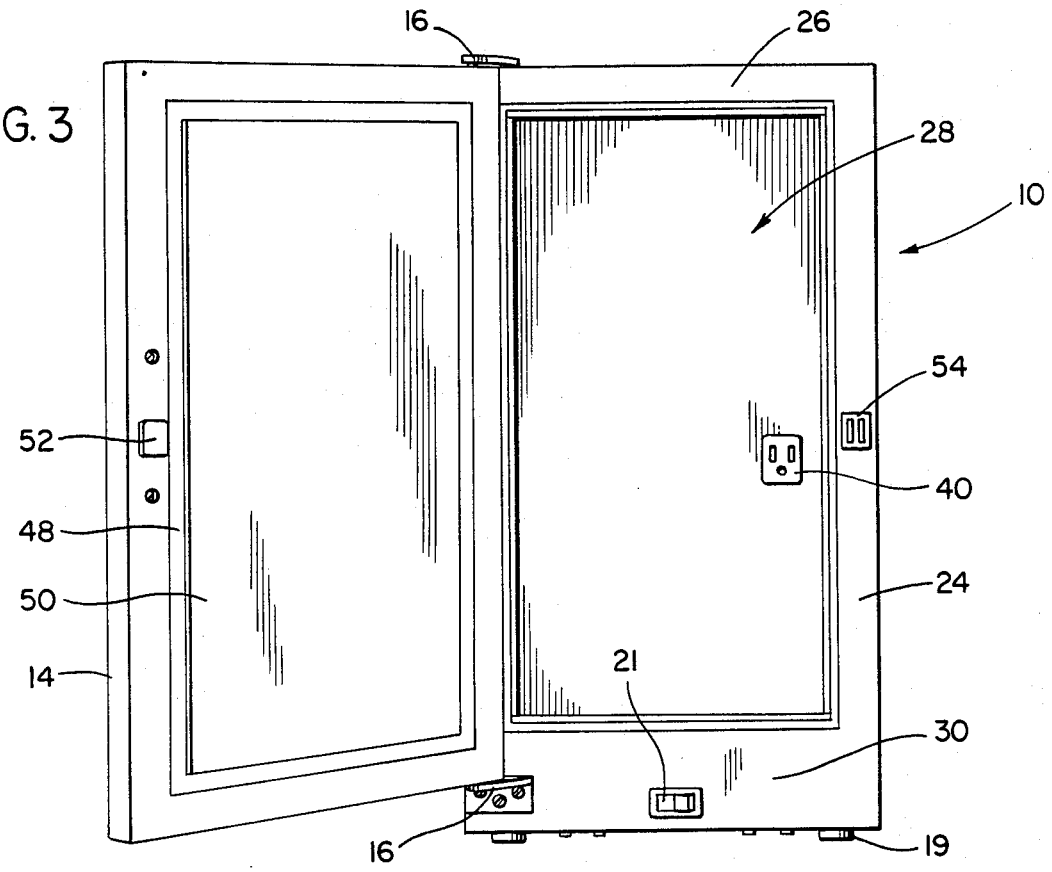

SOUND INSULATING CONTAINER FOR AN ELECTRICAL APPLIANCE

BACKGROUND OF THE INVENTION

The present invention relates to a sound insulating container. More specifically, the present invention relates to a sound insulating container for an electrical appliance.

It is well known that many public restaurants, cocktail lounges, and the like, are required to have well-controlled atmospheres. This includes well-controlled sound levels. Often, when preparing cocktails that must be mixed in an electric blender, a bartender will suddenly interrupt the quiet or controlled sound level of the restaurant or lounge. A similar situation can arise in any controlled environment where an electrical appliance must frequently be used which produces an undesirable sound during operation.

There have been devices designed to muffle the sound produced by an electrical apparatus. Specifically, U.S. Pat. No. 1,443,688 to Hurd discloses a sound deadening box comprising a body constructed of sound muffling material and a door to enclose the box. The electrical apparatus placed within the box must be self-powered.

Other prior art sound insulating devices include that described in U.S. Pat. No. 2,491,453 to Knobel. The Knobel patent discloses a container for enclosing the escapement mechanism of a clock; the container is constructed of sound insulating material.

SUMMARY OF THE INVENTION

It is a primary object of this invention to provide an apparatus to contain an electrical appliance, absorb the sound produced during operation of the appliance, and provide easy access to the appliance for repeated use.

It is an additional object of this invention to provide a sound insulating container for completely enclosing an electrical appliance and providing a switchable power supply operable from outside the closed container for operating the electrical appliance.

Specifically, the present invention comprises a sound insulating container for completely enclosing an electrical appliance, such as an electric blender. The container includes an electrical outlet mounted on an interior wall and connectable via a conventional electric cord to a standard wall outlet. A switch connected to the interior outlet is provided on the exterior of the container for selectively operating the enclosed electrical appliance.

The container is constructed of two side walls, a top wall, a bottom wall, and a door hingedly attached to one of the side walls. The four walls are constructed of layers of diverse sound absorbing material to provide maximum sound insulation. The bottom wall includes a removable panel to access an electrical cord feed area for storage. The door is provided with a handle for movement between an open and closed Position and a magnetic latch for maintaining the door in its closed position during operation of an electrical appliance.

The above and other objects and advantages of the invention which will become subsequently apparent in the details of construction and operation as more fully hereinafter described and claimed, reference being made to the accompanying drawings forming a part hereof, wherein like numerals refer to like parts throughout.

BRIEF DESCRIPTION OF THE DRAWINGS

FIG. 1 is a side view of the sound insulating container of the present invention.

FIG. 3 is a front perspective view of the sound insulating container of the present invention with its door in an open position.

DETAILED DESCRIPTION OF THE PREFERRED EMBODIMENT

Figure 2:
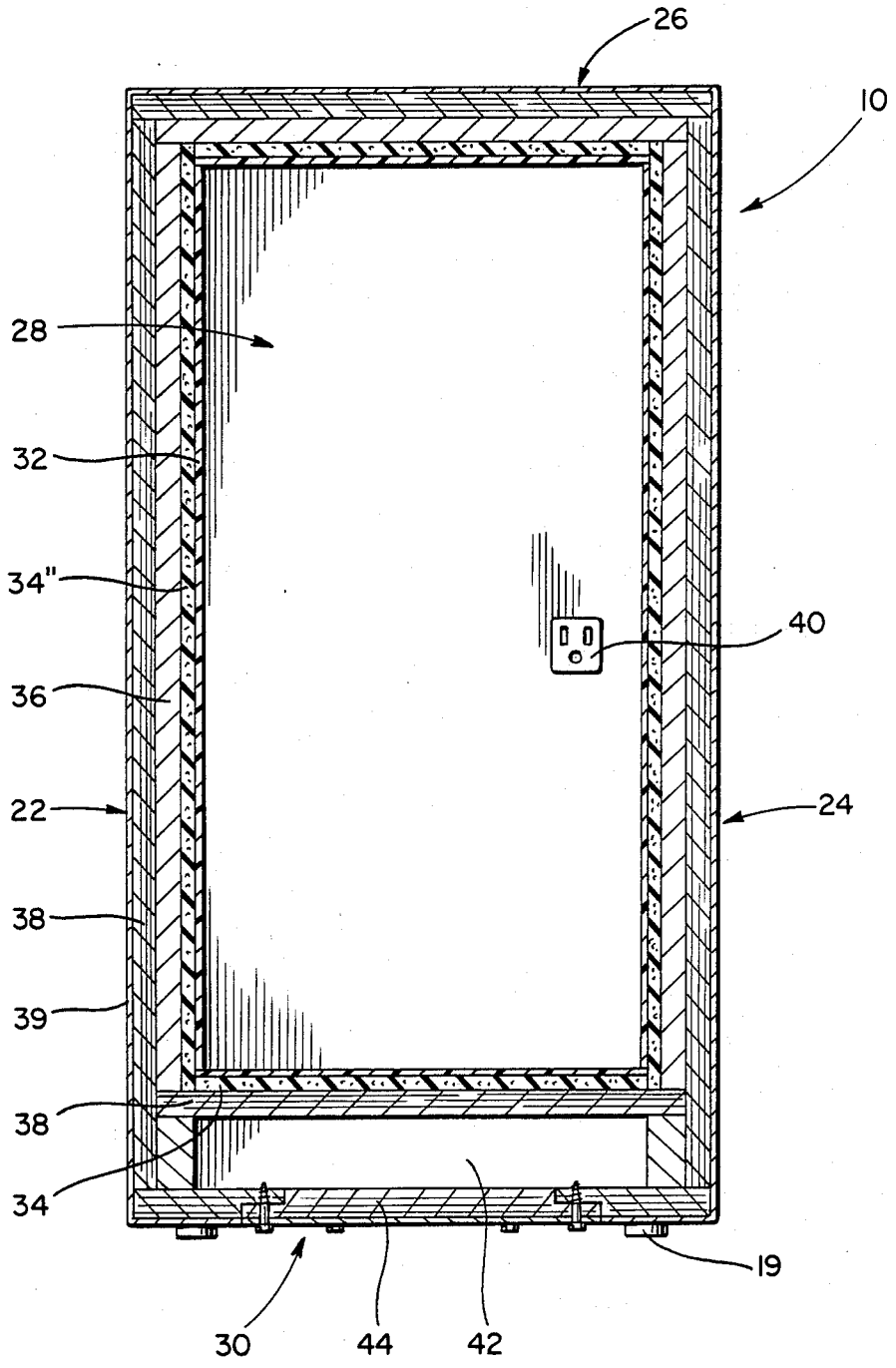
FIG. 2 is a cross-sectional view taken through line 2—2 in FIG. 1.

Referring first to FIG. 1, the sound insulating container 10 is shown comprising a body 12 and a door 14. The door 14 is attached to the body 12 by hinged brackets 16 which allow the door to be moved between open and closed positions via the handle 18. The container 10 is supported by rubber feet 19 attached to the bottom of the body 12. An electrical cord 20 is connected to the rear wall of the body 12 and internally connected to an interior outlet inside the container 10 (not shown in this figure). An external electrical switch 21 on the front of the container 10 is also provided.

FIG. 2 shows the construction of the body 12 in more detail. Specifically, the body comprises side walls 22 and 24, a top wall 26, a rear wall 28, and a bottom wall 30. The side walls 22 and 24, top wall 26, and rear wall 28 are constructed from an innermost layer 32 of plastic material which is further enclosed by a layer 34 of foam rubber. A layer 36 of Homasote board encloses the rubber layer 34 and is itself surrounded by a layer 38 of plywood. Finally, a laminating material 39 is employed to coat the outer surface of the layer 38. An electrical outlet 40 is located on the inner side of the rear wall 28 and is electrically connected to the electrical cord 20 via the electrical switch 21. The switch 21 is positionable to ON and OFF positions.

The bottom wall 30 is constructed of the same layers as the other walls with the exception of the layer 36 of Homasote board. This layer is omitted and a layer 38 of plywood is directly attached to the rubber layer 34. Thus, a space 42 is created and is enclosed from the bottom by a removable plywood panel 44.

FIG. 3 shows the container 10 with the door 14 in an open position. The inner face of the door 14 includes a layer 48 of foam rubber topped by a concentric layer 50 of plastic. The rubber layer 48 occupies more area on the door to provide a secure seal with the inner edges of the side walls 22 and 24, and top and bottom walls 26 and 30, respectively. In addition, though not specifically shown, it is envisioned that the foam rubber layer 34 is recessed and bevelled along the outer edges of the walls 24, 26, 30. This will further ensure a tight fit when the door 14 is closed. A metal plate 52 attached to the inner surface of the door and a magnet 54 mounted on the side wall 24 form a magnetic latching mechanism to hold the door in its closed position.

In operation, the container 10 is set on a horizontal surface and the electrical cord 20 is plugged into a standard wall outlet. An electrical appliance, such as an electric blender, is placed inside the container and is plugged into the inner outlet 40 on the rear wall 28. The appliance is turned on via its own switch. When it is desired to operate the appliance, the door 14 is closed and the switch 21 is placed to its ON position. The enclosed electrical appliance will then be supplied with electrical power for operation while the sound produced by the appliance will be absorbed by the walls of the container 10. For example, when using an electric blender having a removable stirring cup, the cup is filled with the contents to be mixed and is inserted on the blender. The door 14 is then closed and the switch 21 is pressed to its ON position. When blending is complete the switch 21 is turned OFF and the stirring cup is removed. Thus, a bartender can use a blender in the dining area of a public restaurant or lounge without disturbing the controlled sound level desired.

It is considered within the scope of this invention that the container 10 may be formed into various sizes and dimensions for use with various types of electrical appliances.

The above description is intended by way of example only and is not intended to limit the present invention in any way except as set forth in the following claims.

I claim:

1. A sound insulating apparatus for enclosing and containing an electrical appliance comprising:

a body having at least side walls, a bottom wall, and a rear wall, all constructed of sound absorbing material;

a door constructed of sound absorbing material for forming a sealed enclosure when in a closed position;

an electric cord attached at the exterior of said body;

an electrical outlet inside said body and electrically connected to said electric cord;

an electrical switch located on the exterior of said body when said door is in its closed position and electrically connected to said interior electrical outlet for selectively supplying electrical power to said outlet.

2. The sound insulating container of claim 1 wherein said sound insulating material comprises interior and exterior faces of plastic and plywood, respectively, surrounding a layer of foam rubber adjacent the plastic and a layer of Homasote board sandwiched between the foam rubber and plywood.

3. The sound insulating container of claim 1 wherein said door is pivotal between open and closed positions and is locked in a closed position by a latching mechanism.

* * * * *